United States Patent [19]

McCaffrey

[11] 4,226,332

[45] Oct. 7, 1980

[54] EQUALIZATION SYSTEM FOR OVERHEAD CRANES

[75] Inventor: Felim P. McCaffrey, Toronto, Canada

[73] Assignee: Hatch Associates Ltd., Toronto, Canada

[21] Appl. No.: 98,881

[22] Filed: Nov. 30, 1979

Related U.S. Application Data

[63] Continuation of Ser. No. 921,451, Jul. 3, 1078, abandoned.

[51] Int. Cl.[3] ..... B66C 9/12

[52] U.S. Cl. ..... 212/218; 105/163 R

[58] Field of Search ..... 212/13; 105/163 R, 163 SK, 105/164; 280/104

[56] References Cited

U.S. PATENT DOCUMENTS

| | | | |
|---|---|---|---|
| 820782 | 9/1959 | GBX . | |
| 1,894,776 | 1/1933 | Liang | 280/104 |
| 3,877,391 | 4/1975 | Gimperlein | 105/163 R |

FOREIGN PATENT DOCUMENTS

| | | | |
|---|---|---|---|
| 1086917 | 10/1967 | United Kingdom | 212/13 |
| 331959 | 3/1972 | U.S.S.R. . | |

*Primary Examiner*—Robert G. Sheridan

*Attorney, Agent, or Firm*—Ridout & Maybee

[57] ABSTRACT

In a bridge crane, a rigid rectangular crane bridge frame is supported on a main runway by a truck at each corner, and in order to eliminate loadings on the trucks due to distortion of the runway, the trucks on one side of the bridge support the bridge frame through interlinked levers forming part of an equalizing linkage.

3 Claims, 3 Drawing Figures

EQUALIZATION SYSTEM FOR OVERHEAD CRANES

CROSS-REFERENCE TO RELATED APPLICATIONS

This is a continuation of application Ser. No. 921,451, filed July 3, 1978, now abandoned.

FIELD OF THE INVENTION

This invention relates to overhead cranes of the kind in which a bridge frame carrying a laterally moveable trolley supporting the hoisting machinery is supported on a main runway by means of a truck at each corner.

BACKGROUND OF THE INVENTION

A problem affecting such overhead cranes is local deflection or subsidence of the runway or its supports. If the bridge frame of the crane is rigid, and the trucks directly support the frame, any resulting lack of alignment of the track can result in gross inequality of the loads transmitted through the different trucks. This results in increased stresses being applied to the runway, those trucks whose loading is increased, and the frame. In extreme cases, even quite small runway deflections can result in the load applied to one or even two of the trucks being reduced to zero. Various approaches to this problem have been adopted. One solution is to render the bridge frame sufficiently flexible to accomodate deflections and subsidences of the runway, typically either by forming the frame of two spaced but linked members or by placing a flexible link in the periphery of the frame. Such techniques permit distortions in the frame which would otherwise give rise to very high torsional stresses. Disadvantages of these solutions are that a distortion of the bridge frame will also result in distortion of the secondary runway provided on the frame for the trolley, which must therefore itself be designed to accomodate such distortion. Furthermore, the tracking of such a frame as it moves along the main runway is inferior to that of a rigid frame, with the result that the frame may tend to become misaligned on the runway. If a rigid frame is retained, problems in maintaining alignment of the trolley runway are eliminated, and tracking problems are reduced. On the other hand, the transfer of loads between the trucks supporting the frame on the main runway will result in very high torsional stresses being applied to the frame. Thus the designers of the crane and the runway must consider the interaction between the stiffness characteristics of the frame, and the probable degree of subsidence and deflection likely to occur in the runway. It is of course often difficult to estimate the likely degree of subsidence of a runway in advance; although it should in theory be possible to design foundations for the runway structure which in most cases will be free of subsidence, in practice an unpredictable amount of subsidence often tends to occur.

SUMMARY OF THE INVENTION

According to the invention, an overhead crane comprises a generally rectangular bridge frame, a truck beneath each corner of the frame for supporting the latter on parallel rails of a main runway for longitudinal movement, a trolley carrying hoisting machinery and moveable laterally of the rectangular frame, oppositely acting levers forming the connections between the trucks on one side of the frame and the frame itself, and a link interconnecting the levers to equalize the loads on the trucks so connected. In practice, this entails that the loads on the remaining two trucks are unaffected by distortions of the main runway.

Preferably the levers are bell-cranks with longitudinally spaced trunnions and a vertically extending lever arm, the bridge frame resting on the longitudinally outer trunnions of the two levers, and the trucks supporting the longitudinally inner trunnions of the two levers, the lever arms being connected by a link extending between points on the arms spaced upwardly from the trunnions. The link may include a resilient element, whereby to provide some resiliency to the support for the frame.

Further features of the invention will be apparent from the following description of a preferred embodiment.

IN THE DRAWINGS

DESCRIPTION OF THE PREFERRED EMBODIMENT

Figures 1, 2, 3:
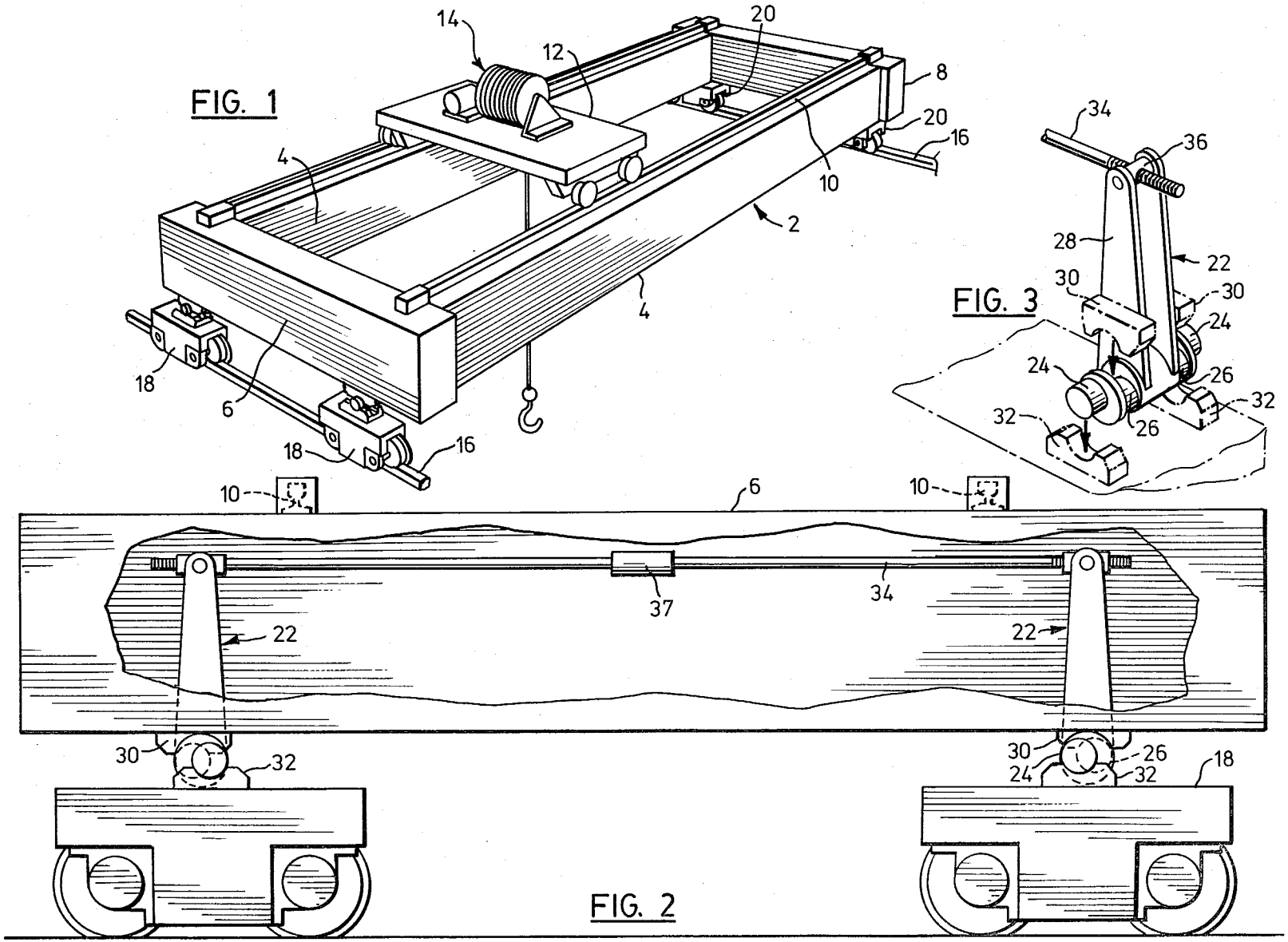
FIG. 1 is a perspective view from above, one end and one side of an overhead crane in accordance with the invention.
FIG. 2 is an end elevation, partially broken away, of the same crane.
FIG. 3 is an exploded detail of the lever system shown connecting the trucks to the frame in FIG. 2.

Referring to FIG. 1, a crane is shown having a rigid rectangular perimeter frame 2 having lateral members 4 and end member 6 and 8. The lateral members 4 carry rails 10 forming a secondary runway for a trolley 12. The trolley 12 supports crane hoisting machinery indicated generally at 14. The frame 2 is supported on a main runway formed by longitudinal rails 16 by means of trucks 18, 20. The trucks 20 are located beneath the ends of the end member 8 by conventional means (not shown), but the trucks 18 are located beneath the ends of the end member 6 by trunnion assemblies forming parts of bell crank levers 22. These trunnion assemblies are best seen in FIG. 3, and each comprises two sets of trunnions 24, 26 slightly spaced longitudinally of the main runway with the axis of the trunnions 24 of one set longitudinally inward and the axis of the trunnions 26 of the other set longitudinally outward at the base of a generally vertically extending lever arm 28. The vertical extent of each lever 28 is very large compared with the horizontal spacing between the axes of the associated trunnions 24, 26, which spacing forms the horizontal lever arm of the bell crank lever 22. Longitudinally outer trunnions 26 are received in saddles 30 beneath the ends of the member 6, whilst the longitudinally inner trunnions 24 rests in saddles 32 on the trucks 18. Thus the application of loads by the beam 6 through the trunnion assembly to the trucks 18 will tend to cause the levers 22 to act in opposition and the lever arms 28 to move apart. Such movement is restrained by means of a link in the form of a tie bar 34 extending between clevises 36 at the upper ends of the lever arms 28 above the trunnions 24 and 26. Since the turning moments applied to the lever arms 28 by the tie bar 34 will be equal and opposite, the loads applied to the trucks 18 through the trunnions 24 must also be equal and opposite provided that the angular movement of the lever assembly is small. This entails that the loadings applied to the trucks 18 must be equal, which in turn implies that no loadings can be applied to the trucks 20 as a result of distortion of the main runway. The levers 22 will thus move in a coordinated manner about the trunnions 26 so as to move the trucks 18 relative to the member 6 to eliminate the loads on all four trucks due to runway distortion.

A small amount of suspension movement may also be introduced into the system by incorporating an extensible element 36 into the bar 34. This member would normally be a compression spring with separate portions of the bar 34 acting on its ends in such a manner as to compress the spring.

What I claim is:

1. An overhead crane comprising a rigid generally rectangular bridge frame, a truck beneath each corner of the frame for supporting the latter on parallel rails of a main runway for longitudinal movement, a trolley carrying hoisting machinery and movable laterally of the rectangular frame, oppositely acting levers forming the connections between the trucks on one side only of the frame and the frame itself, and a link interconnecting the levers independently of the frame to equalize the loads on the trucks so connected, the levers each having a generally vertically extending lever arm and horizontally spaced longitudinally inner and outer trunnions forming a second longitudinally extending lever arm at the base of said vertically extending lever arm, the bridge frame being supported by the longitudinally outer trunnions of the two levers, and the trucks supporting the longitudinally inner trunnions of the two levers, the top ends of the vertically extending lever arms being connected by a link extending between the arms, the vertical extent of each vertically extending lever arm being very large compared to the horizontal extent of the longitudinally extending lever arms formed by the spacing of the axes of the trunnions.

2. A crane according to claim 1, wherein the link incorporates a resilient element.

3. A crane according to claim 1, wherein said vertically extending lever arms and said link are accommodated within said one side of the frame above said trucks.

* * * * *